US006856074B2

(12) United States Patent
Amoros et al.

(10) Patent No.: US 6,856,074 B2
(45) Date of Patent: Feb. 15, 2005

(54) PIEZOELECTRIC IGNITION MECHANISM

(75) Inventors: Enric Amoros, Reus (ES); Eloi Gonzalvo, Tarragona (ES); Jordi Muste, Tarragona (ES)

(73) Assignee: BIC Corporation, Milford, CT (US)

( * ) Notice: Subject to any disclaimer, the term of this patent is extended or adjusted under 35 U.S.C. 154(b) by 214 days.

(21) Appl. No.: 10/085,100

(22) Filed: Mar. 1, 2002

(65) Prior Publication Data

US 2003/0164662 A1 Sep. 4, 2003

(51) Int. Cl.[7] ..... H01L 41/08
(52) U.S. Cl. ..... 310/339
(58) Field of Search ..... 310/338, 339

(56) References Cited

U.S. PATENT DOCUMENTS

| | | | | |
|---|---|---|---|---|
| 3,457,461 A | | 7/1969 | Steinke et al. | 317/81 |
| 3,540,823 A | | 11/1970 | Ebine et al. | 431/255 |
| 3,729,639 A | * | 4/1973 | Heinouchi et al. | 310/339 |

(List continued on next page.)

FOREIGN PATENT DOCUMENTS

| | | |
|---|---|---|
| JP | 60-89625 | 5/1985 |
| JP | 05-66014 | 3/1993 |
| JP | 6-249438 | 9/1994 |
| JP | 11-63498 | 3/1999 |
| JP | 2001-343122 | 12/2001 |
| JP | 2002-54814 | 2/2002 |

*Primary Examiner*—Mark Budd
(74) *Attorney, Agent, or Firm*—Jones Day

(57) ABSTRACT

A piezoelectric ignition mechanism includes first and second body members, a piezoelectric element associated with one of the body members, a plexor member associated with one of the body members, and an engagement portion associated with one of the body members. When the body members are in a first position, the plexor member is releasably retained at a distance from the piezoelectric element, and upon movement of the body members toward a second position, the plexor member is released and driven to impact the piezoelectric element. The engagement portion may be configured and dimensioned to provide resistance against movement of the body members toward the second position.

33 Claims, 17 Drawing Sheets

U.S. PATENT DOCUMENTS

| | | | | | |
|---|---|---|---|---|---|
| 3,734,680 | A | | 5/1973 | Maruyama | 431/132 |
| 3,817,691 | A | | 6/1974 | Tatsumi | 431/255 |
| 3,829,737 | A | * | 8/1974 | Johnsson | 361/247 |
| 3,883,289 | A | | 5/1975 | Fujioka | 431/131 |
| 3,898,534 | A | | 8/1975 | Mohr | 317/81 |
| 4,608,508 | A | * | 8/1986 | Ohnishi | 310/339 |
| 4,626,731 | A | * | 12/1986 | Sadoya | 310/339 |
| 4,758,152 | A | | 7/1988 | Kordecki | 431/153 |
| 4,830,603 | A | | 5/1989 | Cirami | 431/153 |
| 5,002,482 | A | | 3/1991 | Fairbanks et al. | 431/277 |
| 5,035,608 | A | | 7/1991 | Parren | 431/153 |
| 5,059,852 | A | | 10/1991 | Meury | 310/339 |
| 5,092,764 | A | | 3/1992 | McDonough et al. | 431/277 |
| 5,125,829 | A | | 6/1992 | McDonough et al. | 431/255 |
| 5,171,143 | A | | 12/1992 | Sohn | 431/153 |
| 5,178,532 | A | | 1/1993 | Frigiere | 431/254 |
| 5,215,458 | A | | 6/1993 | Cirami | 431/277 |
| 5,240,408 | A | | 8/1993 | Uematsu et al. | 431/153 |
| 5,262,697 | A | * | 11/1993 | Meury | 310/339 |
| 5,417,563 | A | | 5/1995 | Cirami | 431/153 |
| 5,417,571 | A | | 5/1995 | Kvalseth | 431/153 |
| 5,435,719 | A | | 7/1995 | McDonough et al. | 431/153 |
| 5,487,657 | A | | 1/1996 | Fairbanks et al. | 431/153 |
| 5,584,682 | A | | 12/1996 | McDonough et al. | 431/153 |
| 5,628,627 | A | | 5/1997 | Fairbanks et al. | 431/153 |
| 5,636,979 | A | | 6/1997 | McDonough et al. | 431/153 |
| 5,642,993 | A | | 7/1997 | McDonough et al. | 431/153 |
| 5,788,474 | A | | 8/1998 | Chung et al. | 431/153 |
| 5,854,530 | A | * | 12/1998 | LaForest et al. | 310/339 |
| 5,927,962 | A | | 7/1999 | Amoros Nollas et al. | 431/255 |
| 5,980,239 | A | | 11/1999 | Doucet et al. | 431/153 |
| 6,010,328 | A | | 1/2000 | Sung | 431/153 |
| 6,045,354 | A | | 4/2000 | McDonough et al. | 431/153 |
| 6,046,528 | A | * | 4/2000 | LaForest et al. | 310/339 |
| 6,065,958 | A | | 5/2000 | Adams et al. | 431/153 |
| 6,074,198 | A | | 6/2000 | Rogelet | 431/153 |
| 6,077,069 | A | | 6/2000 | Fairbanks et al. | 431/153 |
| 6,077,070 | A | | 6/2000 | Doucet et al. | 431/153 |
| 6,077,071 | A | | 6/2000 | Yeh | 431/153 |
| 6,086,358 | A | | 7/2000 | Potskhishvili et al. | 431/153 |
| 6,086,359 | A | | 7/2000 | Sher | 431/153 |
| 6,095,795 | A | | 8/2000 | Potskhishvili et al. | 431/153 |
| 6,095,796 | A | | 8/2000 | Sung | 431/153 |
| 6,099,296 | A | | 8/2000 | Wang | 431/153 |
| 6,099,297 | A | | 8/2000 | Chan | 431/153 |
| 6,099,298 | A | | 8/2000 | Potskhishvili et al. | 431/153 |
| 6,102,689 | A | | 8/2000 | Man | 431/153 |
| 6,106,277 | A | | 8/2000 | Xie | 431/153 |
| 6,116,892 | A | | 9/2000 | Yang | 431/153 |
| 6,382,960 | B1 | * | 5/2002 | Frigiere et al. | 431/153 |
| 2002/0136996 | A1 | | 9/2002 | Ichikawa et al. | 431/153 |

* cited by examiner

PIEZOELECTRIC IGNITION MECHANISM

FIELD OF THE INVENTION

The present invention relates generally to ignition mechanisms and devices containing ignition mechanisms, such as, for example, lighters, including pocket and extended-wand type lighters, disposable and non-disposable lighters. More specifically, the present invention relates to piezoelectric ignition mechanisms and piezoelectric lighters, including particularly such ignition mechanisms and lighters that present increased resistance to operation.

BACKGROUND OF THE INVENTION

Disposable gas lighters are available in a variety of forms. Typically, one common element of disposable lighters is a fuel release lever that is used to initiate a flow of fuel. The fuel release lever is typically operated in conjunction with a spark producing mechanism so that the flow of fuel is ignited soon after it commences. For example, one type of lighter requires a user to rotate a toothed spark wheel against a flint in order to generate a spark, simultaneously with, or immediately followed by, depressing the fuel release lever to release a gas and produce a flame.

Other means of ignition for disposable lighters employ a piezoelectric mechanism. In this type of ignition mechanism, a piezoelectric material, such as a piezoelectric crystal, is struck by a hammer in order to produce an electric spark. The spark is created at the fuel outlet or nozzle to ignite the gaseous fuel. The fuel release lever, upon forced depression by a user, typically commences both the flow of the fuel and then the ignition process. An example of such a piezoelectric ignition mechanism is disclosed in U.S. Pat. No. 5,262,697, entitled "Piezoelectric Mechanism For Gas Lighters."

Measures have been introduced to make activation of lighters more difficult. One typical method employed is to incorporate a latch member that inhibits depression of the fuel release lever. Examples of such mechanisms are shown in U.S. Pat. Nos. 5,435,719; 5,584,682, and 5,636,979. Another example of a piezoelectric lighter that provides increased resistance to operation is disclosed in U.S. Pat. No. 5,854,530. The '530 patent describes a piezoelectric ignition mechanism that has a telescopic assembly having inner and outer members separated by a return spring. The return spring biases the inner and outer members apart, and a user must depress the inner and outer members towards one another in order to activate the ignition mechanism. The device of the '530 patent also includes a resistant spring that provides additional resistance to movement of the inner and outer members towards one another, in order to provide increased resistance to operation.

There remains, however, a need for an ignition device that provides increased resistance to operation, and also improves consumer friendliness and minimizes the number of required components.

SUMMARY OF THE INVENTION

The present invention relates to a piezoelectric ignition mechanism that presents increased resistance to operation, and lighters, including pocket or extended wand type lighters that incorporate the same. In one embodiment, the piezoelectric ignition mechanism includes first and second body members, a piezoelectric element, a plexor member, and an engagement portion associated with the body members. When the body members are in a first position, the plexor member is releasably retained at a distance from the piezoelectric element, and upon movement of the body members toward a second position, the plexor member is released and driven to impact the piezoelectric element. The engagement portion may be configured and dimensioned to provide resistance against movement of the body members toward the second position.

According to one embodiment, one of the body members may define a retaining surface for releasably retaining the plexor member at a distance from the piezoelectric element, and the engagement portion may resist release of the plexor member from the retaining surface. For example, the plexor member may define at least one lug portion, and the engagement surface may resist release of the lug portion from the retaining surface.

Additionally or alternatively, one of the body members may define a ramp surface configured and dimensioned to contact the lug portion and release the lug portion from the retaining surface upon movement of the first and second body members toward the second position, and the engagement portion may be disposed on the ramp surface.

The piezoelectric ignition mechanism of the present invention may be used, for example, to create a spark in a lighter, such as a pocket lighter or a utility lighter having a nozzle disposed at an end of an extended-wand. Other applications and implementations of the piezoelectric ignition mechanism are, however, within the scope of the present invention.

BRIEF DESCRIPTION OF DRAWINGS

To facilitate an understanding of the characteristics, structure and operation of the invention, preferred features of the invention are described in the accompanying discussion, wherein similar reference characters denote similar elements throughout the several views or embodiments, and wherein.

DESCRIPTION OF THE PREFERRED EMBODIMENTS

Figure 1:
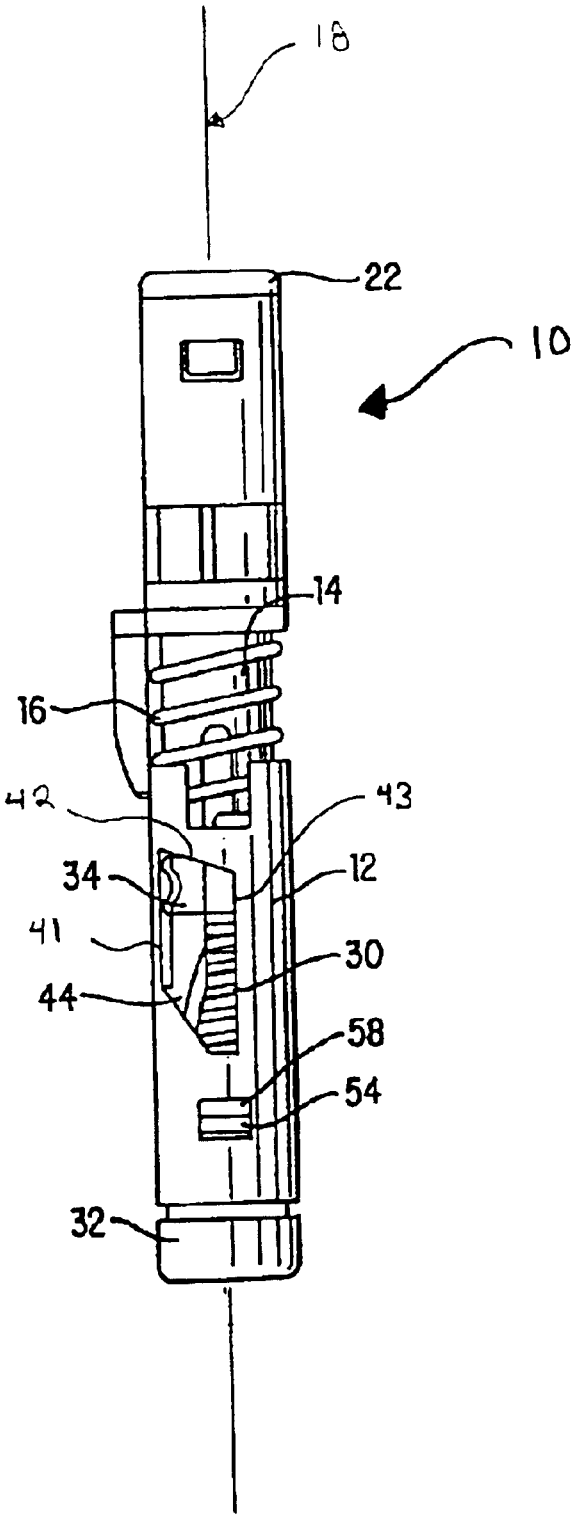
FIG. 1 is a front view of a first embodiment of a piezoelectric ignition mechanism of the present invention in a first, or rest, position.

Referring to the drawings, wherein like reference numbers are used to designate like parts, and wherein preferred features and embodiments of an ignition mechanism are shown for illustrative purposes only and are not intended to limit the scope of the invention, FIG. 1 shows an embodiment of a piezoelectric ignition mechanism 10 according to the present invention. Ignition mechanism 10 includes first and second members 12, 14, respectively, which are configured and dimensioned to move, or preferably slide, with respect to one another along longitudinal axis 18. As shown in FIG. 1, first and second members 12, 14 may be formed similar to concentric hollow tubes with second member 14 being received in first member 12, or vice versa. One skilled in the art will know and appreciate, however, that any number of geometric configurations may be used to provide for movement between first and second members 12, 14. One skilled in the art will further know and appreciate that first and second members 12, 14 are not to be limited to movement along longitudinal axis 18, and may move with respect to one another along any axis. In addition, first and second members 12, 14 may rotate or pivot with respect to one another, e.g., about longitudinal axis 18.

A return spring 16, or any other type of resilient member known in the art, may be positioned between first member 12 and second member 14 to bias the first and second members 12, 14 apart. As shown in the figures, return spring 16 may be disposed over a portion of second member 14, however other configurations of return spring 16 are contemplated and the present invention is not limited to the configuration shown. The first and second members 12, 14 may be constructed with a stop, lip or other means to prevent the two parts from separating under the force of return spring 16. Alternatively or additionally, an external force may be applied to the members by, for example, a lighter body or housing, to maintain the first and second members 12, 14 together.

Figure 2:
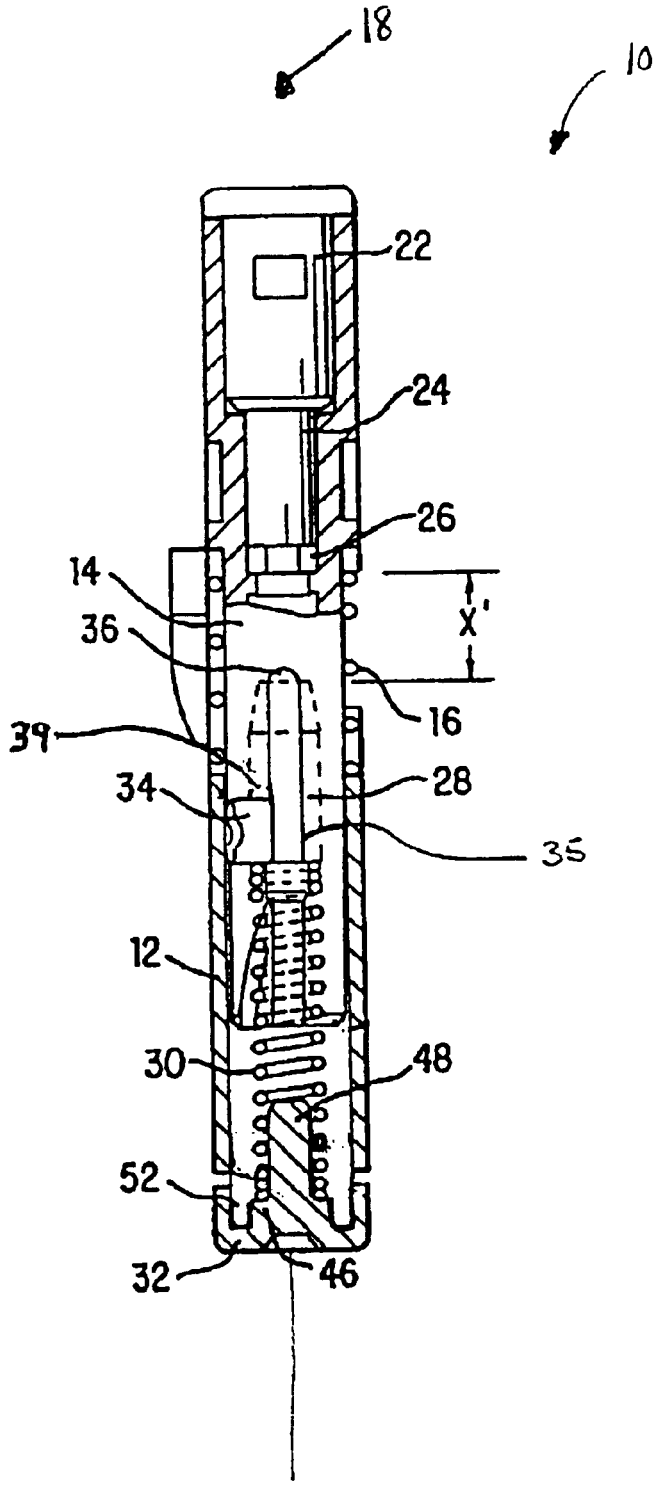
FIG. 2 is a partial cross-sectional view of the ignition mechanism of FIG. 1.

A piezoelectric element 24, and an optional impact pad 26, may be associated with first and second members 12, 14. For example, as shown in FIG. 2, an anvil member 22 may be attached to an end of second member 14 and maintain both piezoelectric element 24 and impact pad 26 inside second member 14. Anvil member 22 is preferably attached to second member 14 with cooperating tabs and grooves, but may alternatively or additionally be attached by other means of attachment, such as screws, cooperating threads, pins, welding or bonding. Alternatively, anvil member 22 and second member 14 may be formed as a single piece around piezoelectric element 24 and optional impact pad 26 (e.g., by insert molding). Impact pad 26 is preferably located adjacent piezoelectric element 24 and transfers impact energy from impact pad 26 directly to piezoelectric element 24. Thus, anvil member 22, piezoelectric element 24, and impact pad 26 are all part of an electrical circuit and cooperate to produce a spark when impact pad 26 is struck by a plexor member 28 with sufficient force, as will be discussed in more detail below. One of ordinary skill in the art will know and appreciate that impact pad 26 is optional and that plexor member 28 may alternatively strike piezoelectric element 24 directly.

Figure 3:
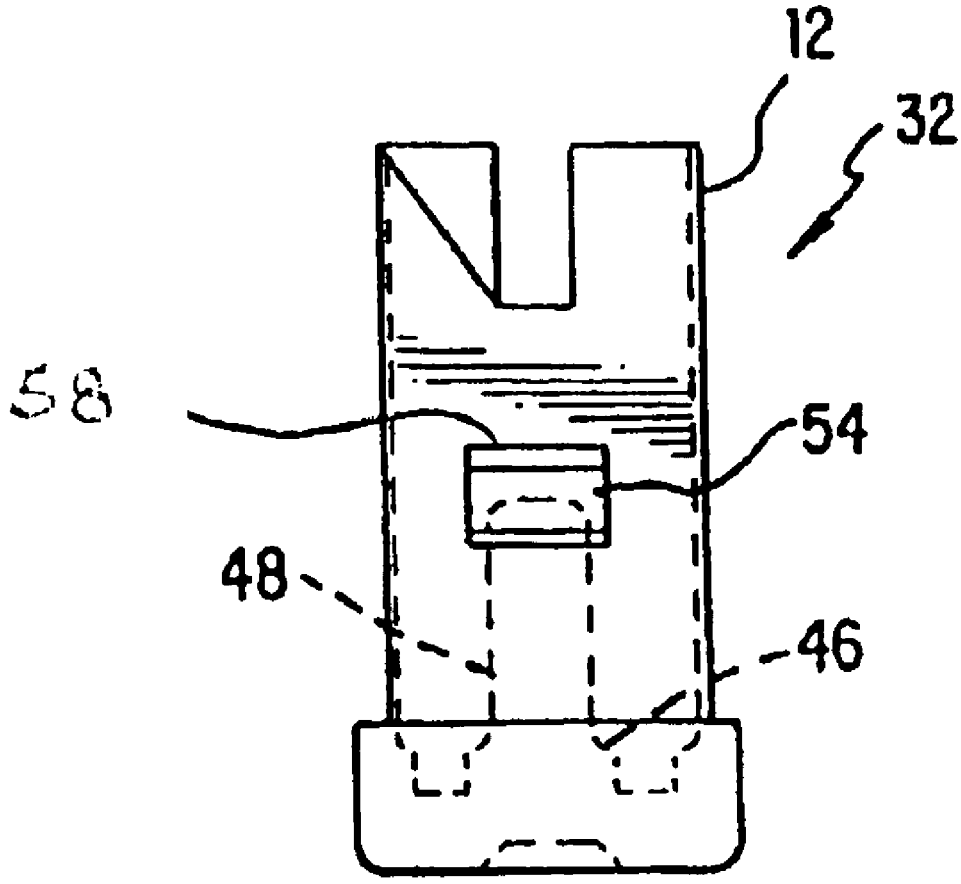
FIG. 3 is a front view of an end member and a portion of a first body member (in phantom) of the ignition mechanism of FIG. 1.

An end member 32, shown in FIGS. 2 and 3, may be provided on one end of first member 12 and may have hooks 54 disposed on opposite sides thereof that engage with openings 58 (shown in FIG. 1) in first member 12, to retain end member 32 on first member 12. Other methods of fastening known in the art, such as glueing, welding, screwing or pinning, could also be used to retain end member 32 on first member 12, or end member 32 may be integrally formed with first member 12. As shown in FIG. 3, end member 32 may be provided with a boss 48 and/or a ledge 46 to retain one end of an impact spring 30, which will be discussed in more detail below.

Still referring to FIG. 2, the plexor member 28 (partially shown in phantom) is associated with the first and second members 12, 14, and is preferably located within second member 14. Plexor member 28 can move longitudinally within a hollow passageway 35 of second member 14, along longitudinal axis 18. An impact spring 30 is associated with first and second members 12, 14 and plexor member 28, and biases plexor member 28 in the direction of impact pad 26 and piezoelectric element 24. As shown in FIG. 2, impact spring 30 is preferably seated at one end on boss 48 of end member 32, with plexor member 28 attached to the other end of impact spring 30.

Figure 4:
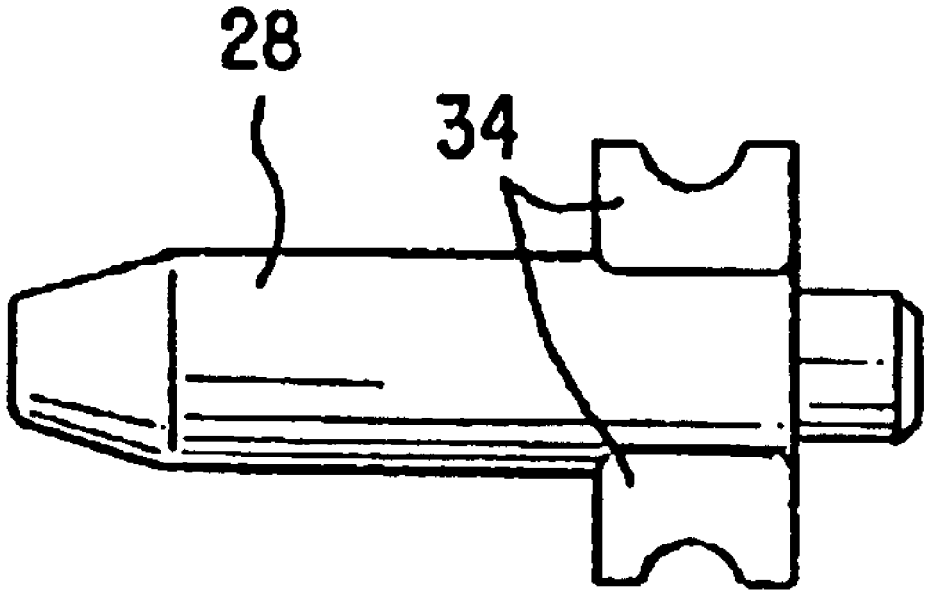
FIG. 4 is a front view of a plexor member of the ignition mechanism of FIG. 1.
Figure 5:
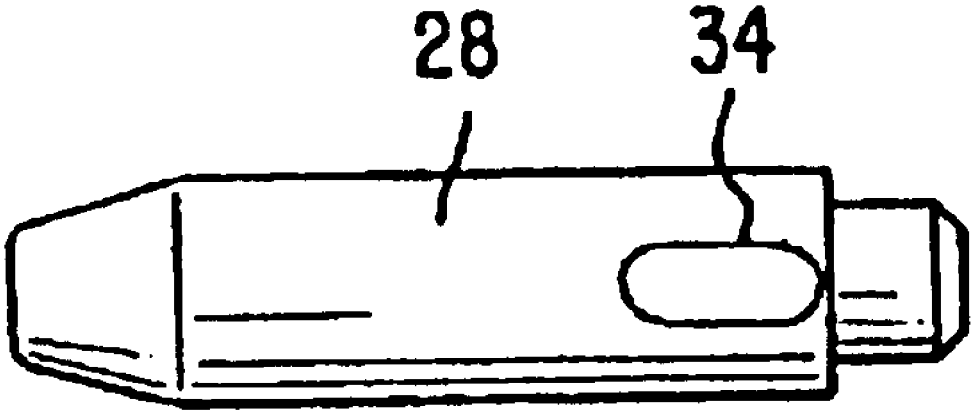
FIG. 5 is a side view of the plexor member of FIG. 4.

Referring to FIGS. 4 and 5, plexor member 28 may be generally cylindrical with a blunt end, and may have two lug portions 34 located on opposite sides thereof. Lug portions 34 may be formed integrally with plexor member 28, or alternatively, may be formed separately and joined to plexor member 28. According to one alternative embodiment, lug portions 34 may be formed by a cylindrical rod having ends that extend out of a bore formed through plexor member 28. Plexor member 28 is not to be limited to the shape shown, and may have any overall shape that will allow it to move in first and second members 12, 14.

Figure 6:
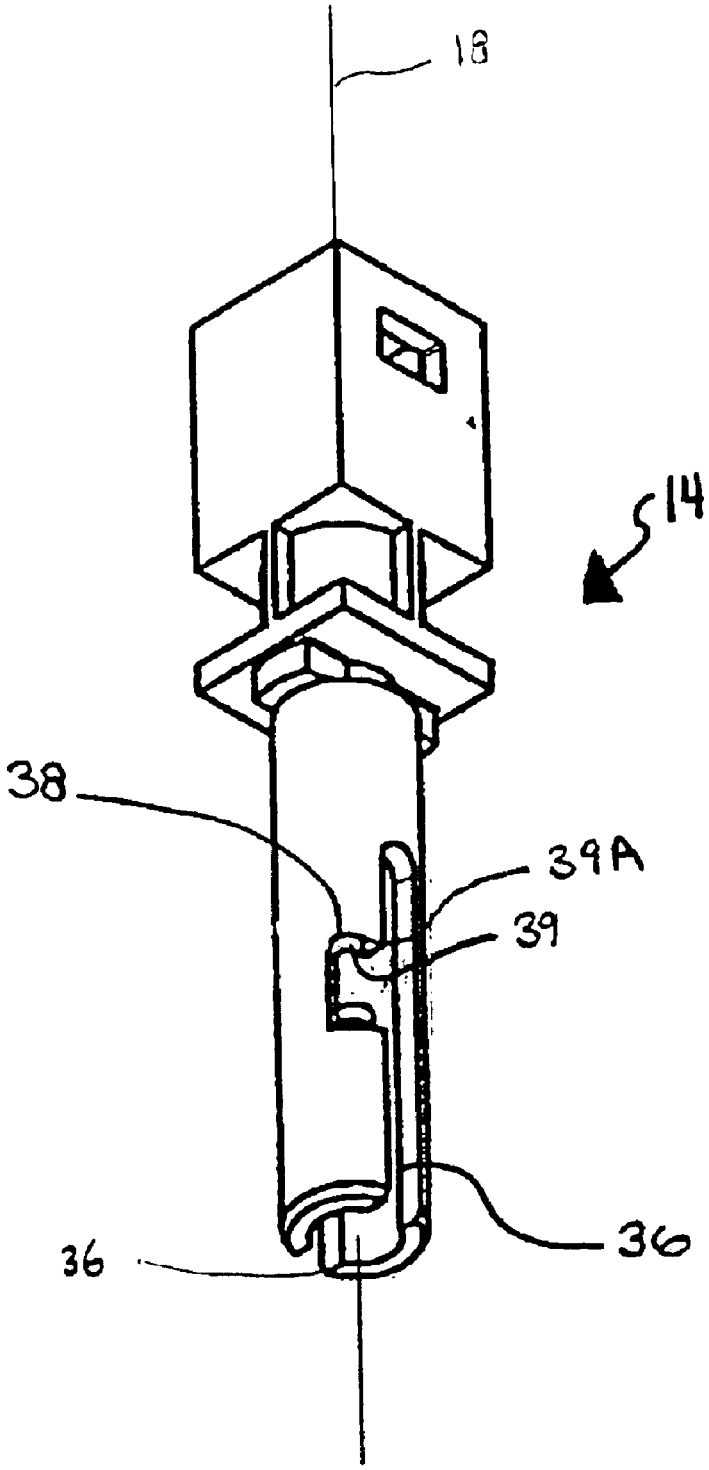
FIG. 6 is a perspective view of a second body member of the ignition mechanism of FIG. 1.

As shown in FIG. 6, tracks 36 may be associated with one of the body members. Tracks 36 are dimensioned and configured to receive lug portions 34 and guide the movement of plexor member 28 along longitudinal axis 18. Retaining surfaces 38 may also be associated with one of the body members. In the embodiment shown, retaining surfaces are defined on second member 14, and are dimensioned and configured to retain the lug portions 34 and substantially prevent movement of plexor member 28 toward piezoelectric element 24. In the illustrative embodiment shown in FIG. 6, tracks 36 are elongated grooves formed in the side walls of second member 14, and retaining surfaces 38 are formed by notches located adjacent the elongated grooves, however other configurations are possible. For example, retaining surfaces 38 may alternatively be defined by a shelf or ledge formed by an increase in the width of tracks 36.

Figure 7:
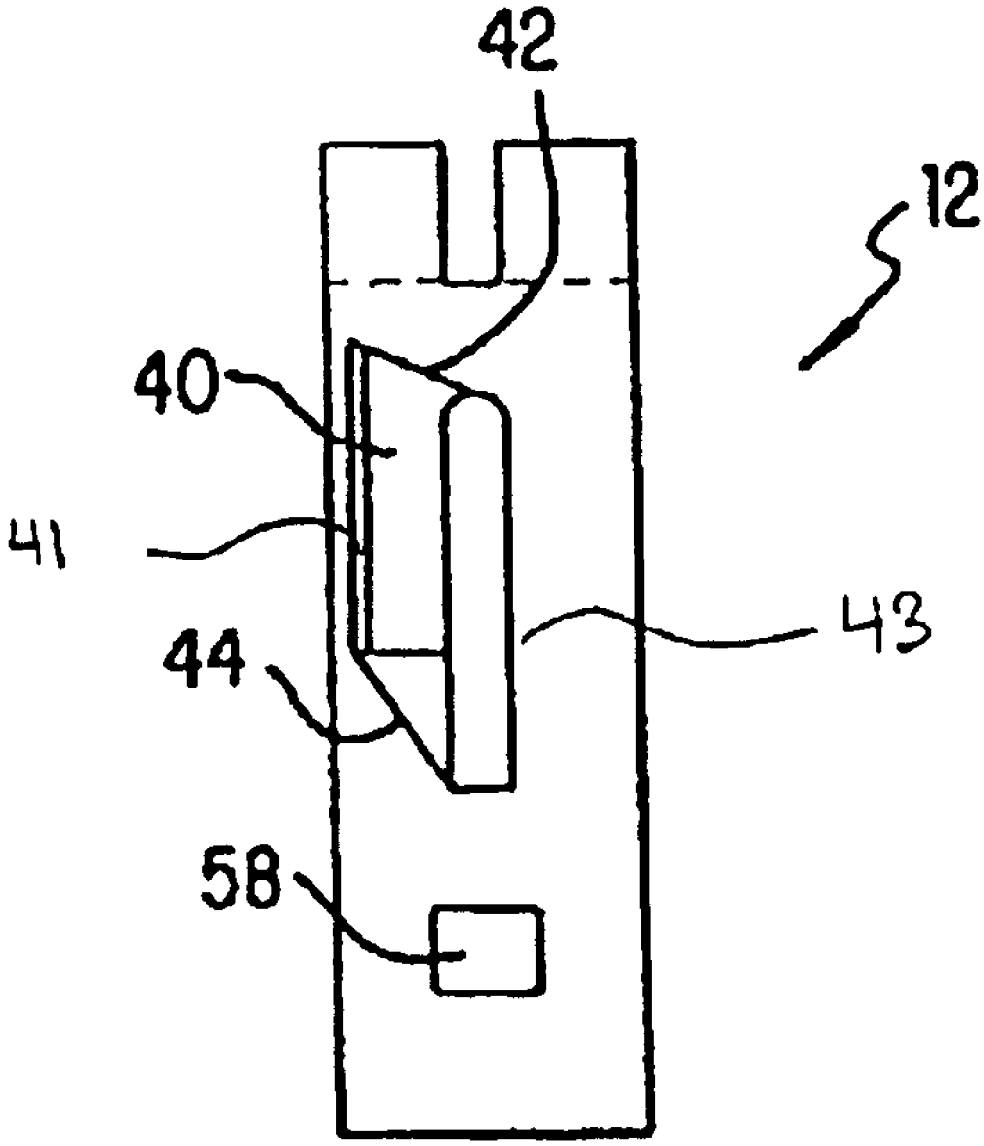
FIG. 7 is a side view of the first body member of the ignition mechanism of FIG. 1.
Figure 7A:
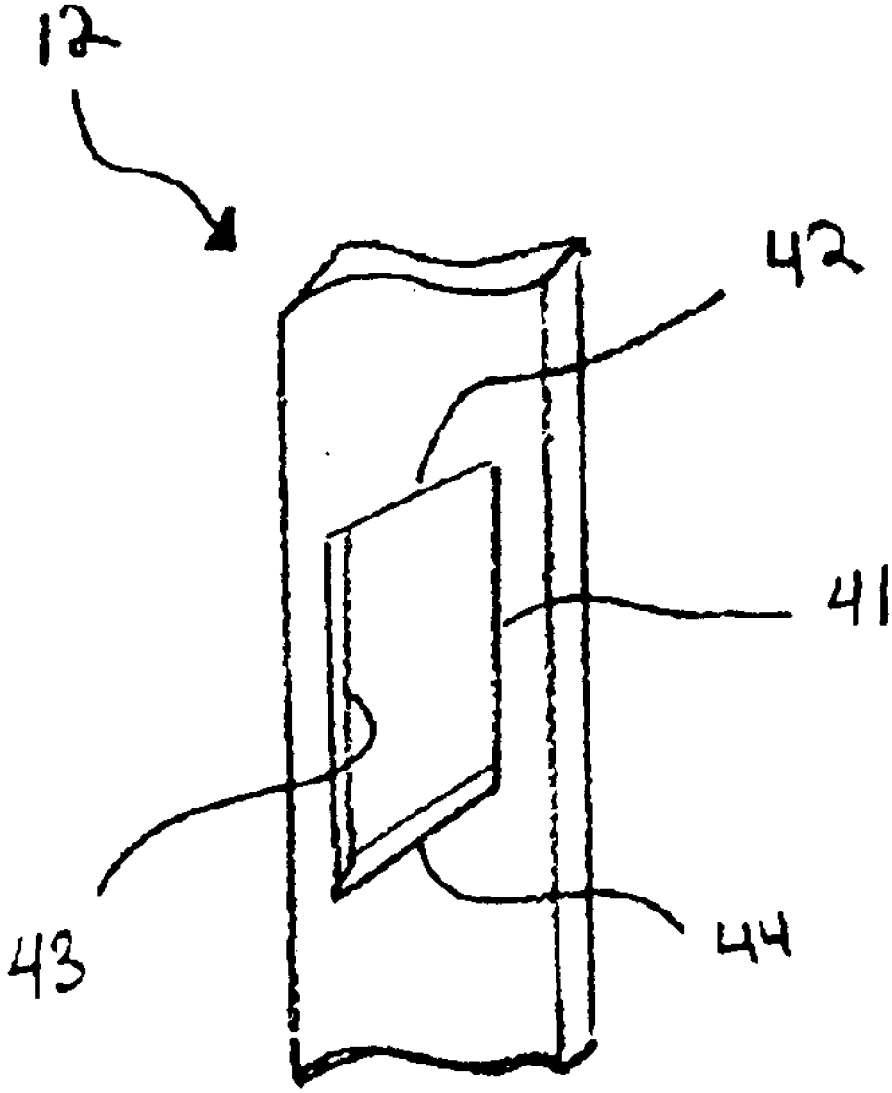
FIG. 7A is a side view of a wall portion of an alternative embodiment of the first body member of FIG. 7.

As shown in FIG. 7, an upper ramp surface 42 and a lower ramp surface 44 may be defined on one of the body members. Optionally, a first side surface 41 and a second side surface 43 may also be defined on one of the body members. In the illustrative embodiment shown, upper and lower ramp surfaces 42, 44 and first and second side surfaces 41, 43 are defined in each side of first member 12. Lug portions 34 are configured and dimensioned to protrude beyond tracks 36 and/or retaining surfaces 38 and to contact the upper and lower ramp surfaces 42, 44 and optionally the first and second side surfaces 41, 43. As shown in the embodiment of FIG. 7, upper and lower ramp surfaces 42, 44 and first and second side surfaces 41, 43 may be defined by the edges of an aperture extending completely through the side walls of first member 12. As shown in FIG. 7A, these surfaces may alternatively be defined by grooves or indentations formed in the side walls of first member 12. Furthermore, one of ordinary skill in the art will know and appreciate that any number of structures may be implemented to provide upper and lower ramp surfaces 42, 44 and first and second side surfaces 41, 43.

Figure 6A:
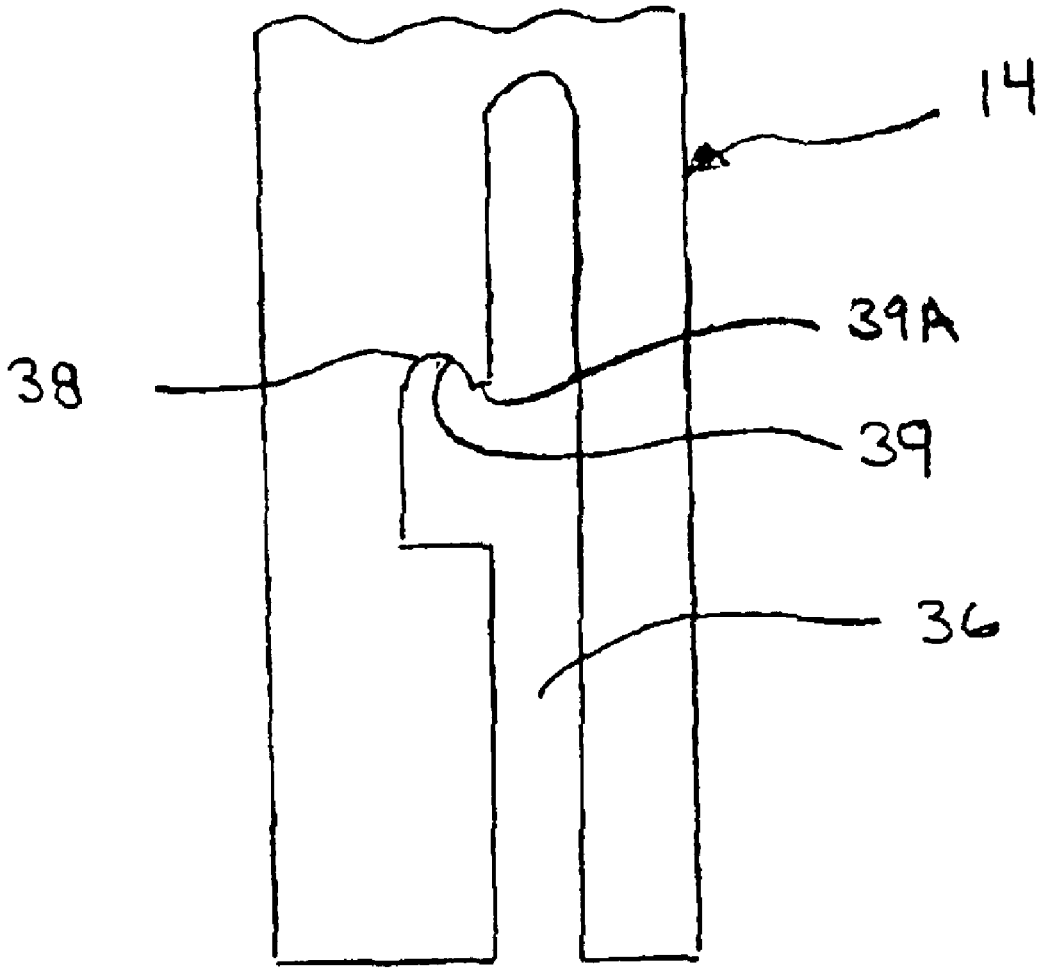
FIG. 6A is a detail view of a retaining surface and engagement portion of the second body member of FIG. 6.
Figure 8:
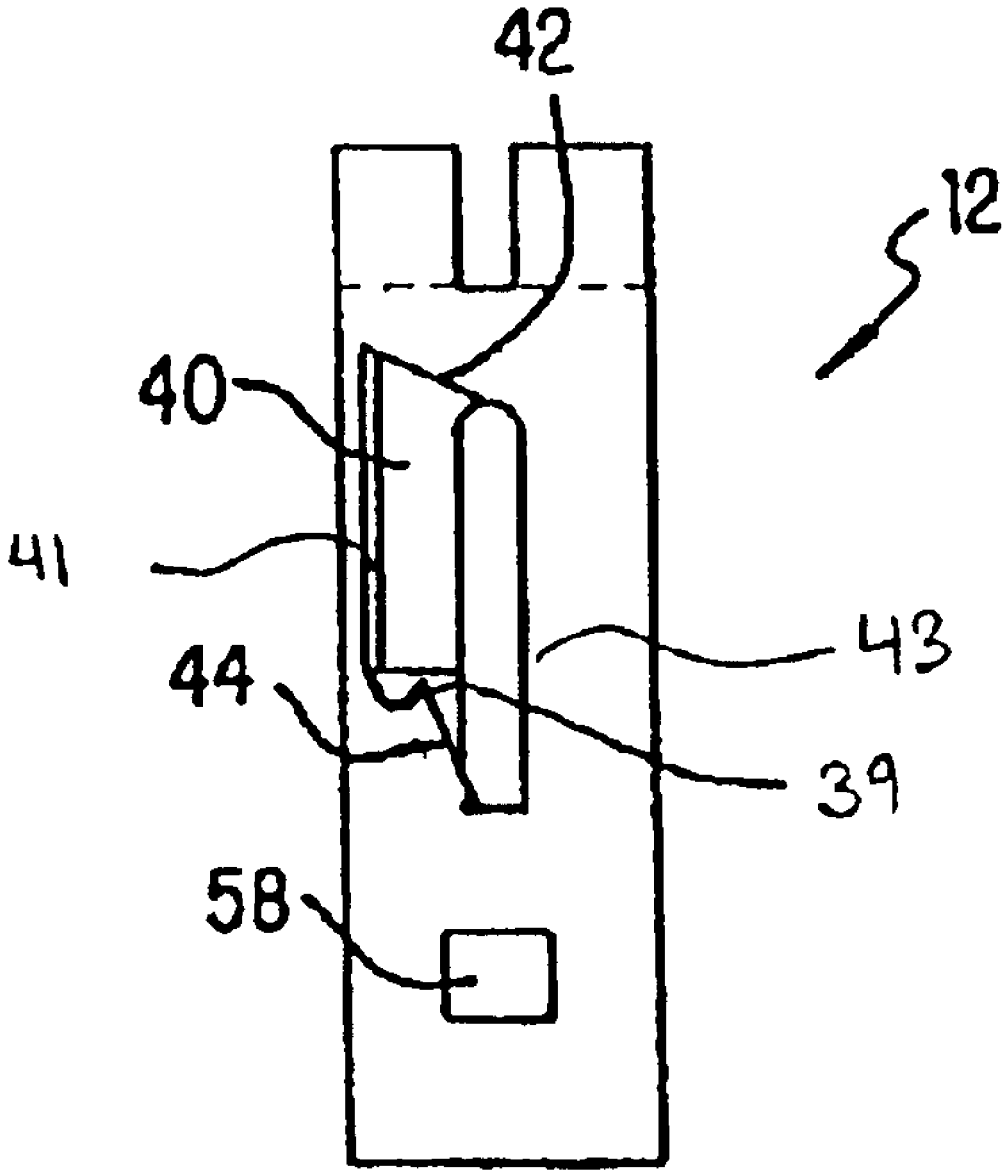
FIG. 8 is a side view of an alternative embodiment of the first body member of FIG. 1, with the engagement portion formed on the lower ramp surface.

Referring back to FIG. 6, retaining surface 38 may be configured and dimensioned to resist release of the lug portion 34 from the retaining surface 38 and into track 36. As shown in FIGS. 6 and 6A, retaining surface 38 maybe provided with an engagement portion 39 that is curved to conform to or partially surround lug 34, and consequently, to influence lug 34 to remain on retaining surface 38. One of ordinary skill in the art will know and appreciate that engagement portion 39 is not to be limited to the shape shown and described, and may have any number of shapes suitable to resist release of lug portion 34 from retaining surface 38. For example, engagement portion 39 may alternatively be ramp-shaped, notched or toothed, or any other shape known to one of ordinary skill in the art to resist release of lug 34 from retaining surface 38. Engagement portion 39 may be resilient or it may be rigid. Additionally or alternatively, engagement portion 39 may include a saw-tooth shaped member 39A formed on or adjacent retaining surface 38, or a resilient latch or a bump formed on or adjacent retaining surface 38, in order to further resist release of lug portion 34. One of ordinary skill in the art will also know that engagement portion 39 and/or member 39A are not to be limited to the location shown and described, and may, as shown in FIG. 8, be provided on lower ramp surface 44. In fact, engagement portion 39 and/or member 39A may be provided at any location on ignition mechanism 10 (or any portion of an assembly into which ignition mechanism 10 is incorporated) in which engagement portion 39 and/or member 39A provides resistance to release of lug portion 34 from retaining surface 38.

When ignition mechanism 10 is in the first or rest position shown in FIGS. 1 and 2, return spring 16 biases the first and second members 12, 14 apart. Also, impact spring 30 biases plexor member 28 upwards such that lugs 34 contact upper ramp surfaces 42. Due to the slope of upper ramp surfaces 42, interaction between lug portions 34 and upper ramp surfaces 42 causes lug portions 34, and consequently plexor member 28, to rotate such that lug portions 34 rotate toward the left and are biased onto retaining surfaces 38. Plexor member 28 is thus retained by lug portions 34 at a distance X' away from impact pad 26, and impact spring 30 is partially compressed.

Figure 9:
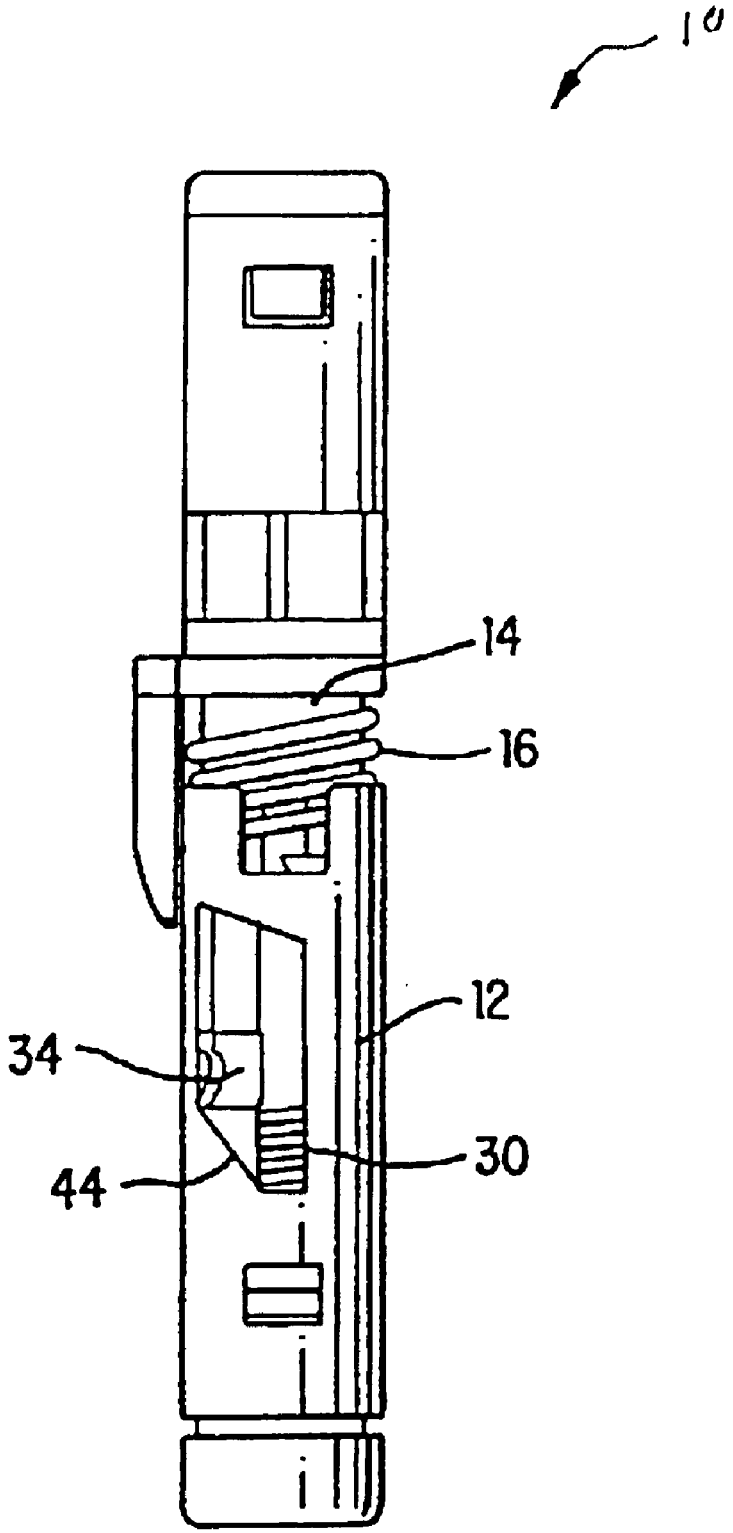
FIG. 9 is a front view of the ignition mechanism of FIG. 1, in a partially-compressed position.
Figure 10:
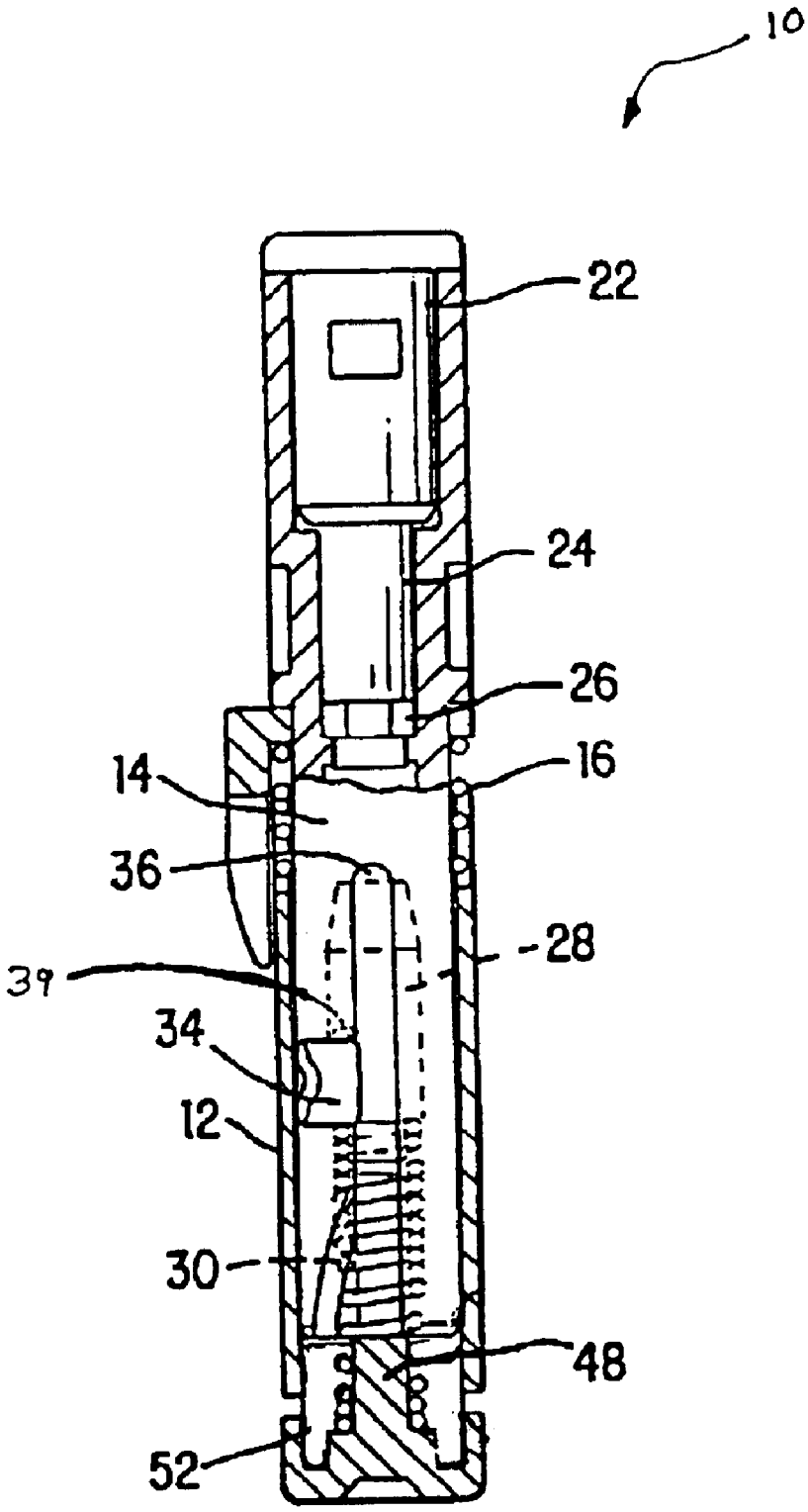
FIG. 10 is a partial cross-sectional view of FIG. 9.

To operate ignition mechanism 10, a user first compresses first and second members 12, 14 toward one another a predetermined distance, against the force of return spring 16 and impact spring 30, until lug portions 34 first contact lower ramp surfaces 44. At or near this point, shown in FIGS. 9 and 10, interaction between lug portions 34 and lower ramp surfaces 44 tends to rotate lug portions 34 off of retaining surfaces 38 and into tracks 36. Because of interference between lug portions 34 and engagement portions 39, the amount of force required to further compress first and second members 12, 14 together is suddenly increased. More specifically, further compression of first and second members 12, 14 tends to push lug portions 34 downward along lower ramp surface 44, thereby rotating lug portions 34 off of retaining surfaces 38. Engagement portions 39, however, tend to prevent lug portions 34 from rotating off of retaining surfaces 38. Thus, to continue to compress first and second members 12, 14 toward the second position, the user must provide an increased force sufficient to overcome the continuing resistance of return spring 16 and impact spring 30, as well as the additional resistance created by interference between lug portions 34 and engagement portions 39.

Figure 11:
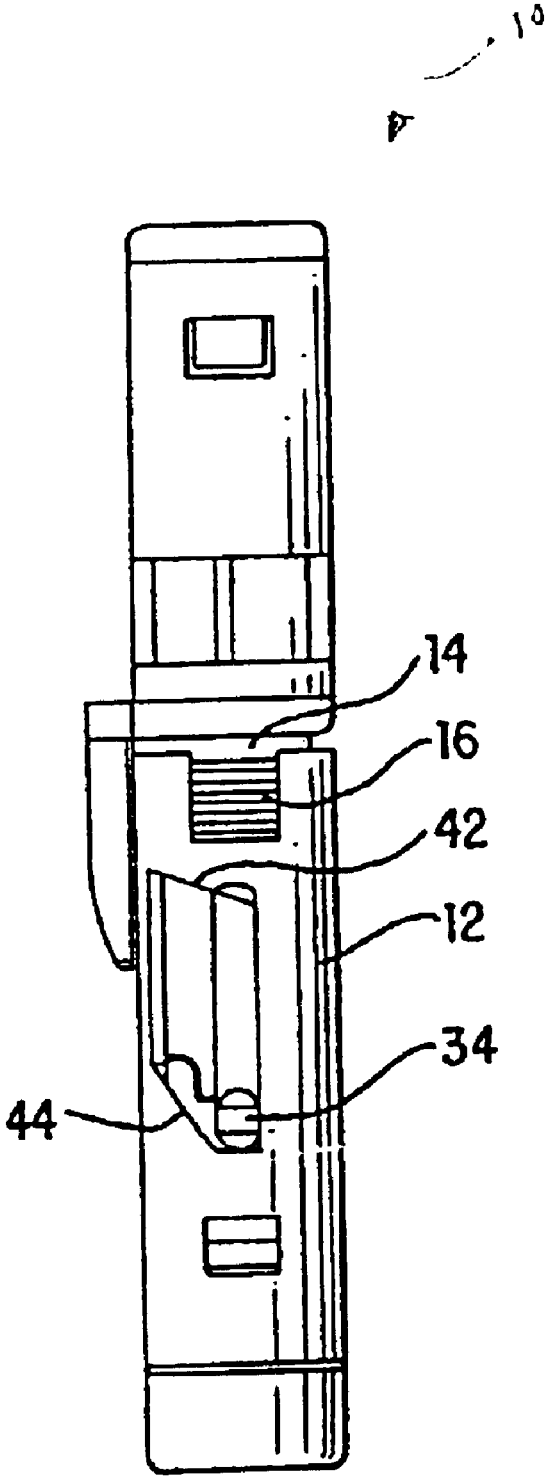
FIG. 11 is a front view of the ignition mechanism of FIG. 1, in a second, or released, position.
Figure 12:
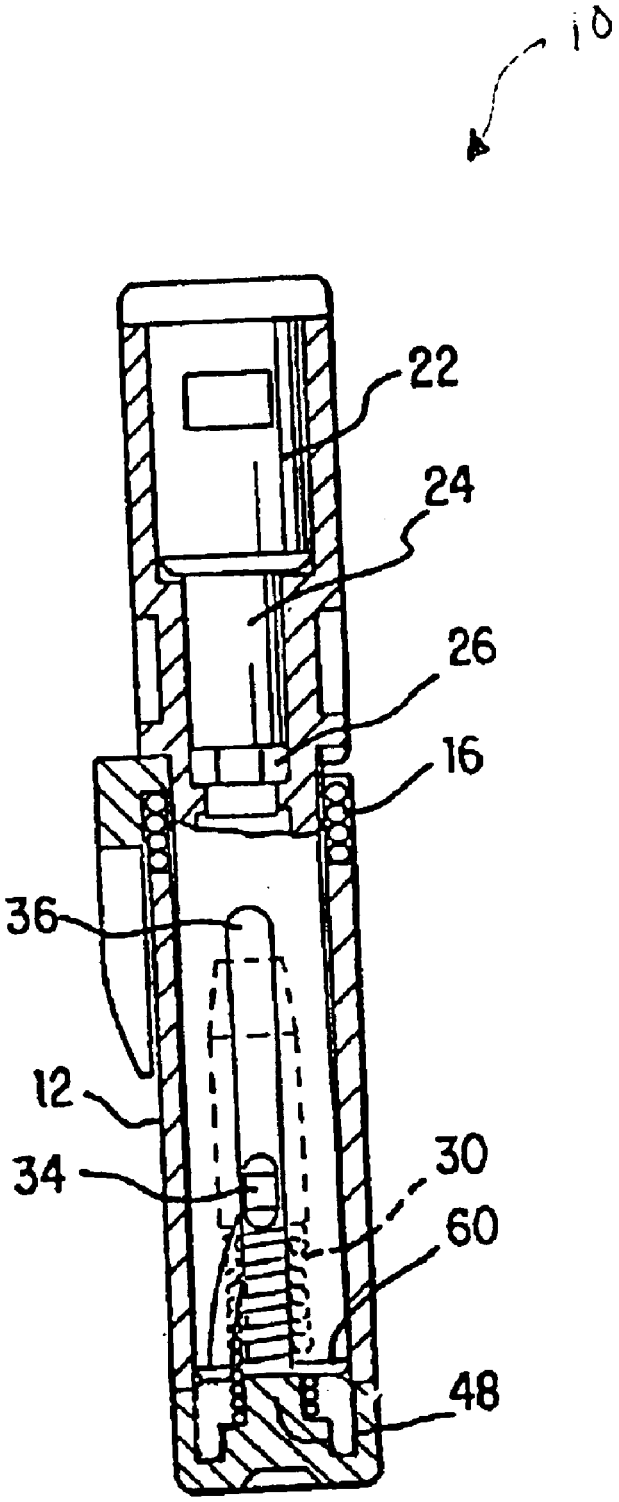
FIG. 12 is a partial cross-sectional view of FIG. 11.

Upon application by the user of the necessary additional force, continued depression of first and second members 12, 14 further compresses return spring 16 and impact spring 30, and also pushes lug portions 34 downward along ramp surface 44. Once first and second members 12, 14 are moved to the second position, shown in FIGS. 11 and 12, plexor member 28 and lug portions 34 are rotated by lower ramp surfaces 44 such that lug portions 34 are released from retaining surfaces 38. At this point, plexor member 28 is driven by compressed impact spring 30 toward impact pad 26 and strikes impact pad 26, thereby transferring the energy stored in impact spring 30 to piezoelectric element 24, and consequently causing piezoelectric element 24 to create an electrical potential.

After the impact pad 26 has been struck by plexor member 28, and pressure is removed from the first and second members 12, 14, return spring 16 expands to separate first and second members 12, 14 from each other. Once lug portions 34 contact upper ramp surfaces 42, continued separation of first and second members 12, 14, under the force of return spring 16, causes lug portions 34 to ride along upper ramp surfaces 42 until lug portions 34 are once again located on retaining surfaces 38. Once the first and second members 12, 14 are fully separated, and lug portions 34 are located on retaining surfaces 38, ignition mechanism 10 is in the first or rest position discussed above, and is ready for subsequent operation.

Engagement portions 39, as well as return spring 16 and/or impact spring 30, may be selectively configured to provide a desirable increase in resistance to compression of first and second members 12, 14 to the second position. For example, return spring 16 and/or impact spring 30 may be configured (e.g., by varying their spring constants) to provide a first amount of resistance to movement of first and second members 12, 14 to the predetermined position shown in FIGS. 9 and 10, and engagement portions 39 may be configured (e.g., by varying their shape or material properties) to provide a second, greater amount of resistance to movement of first and second members 12, 14 to the second or released position shown in FIGS. 11 and 12.

Figure 13:
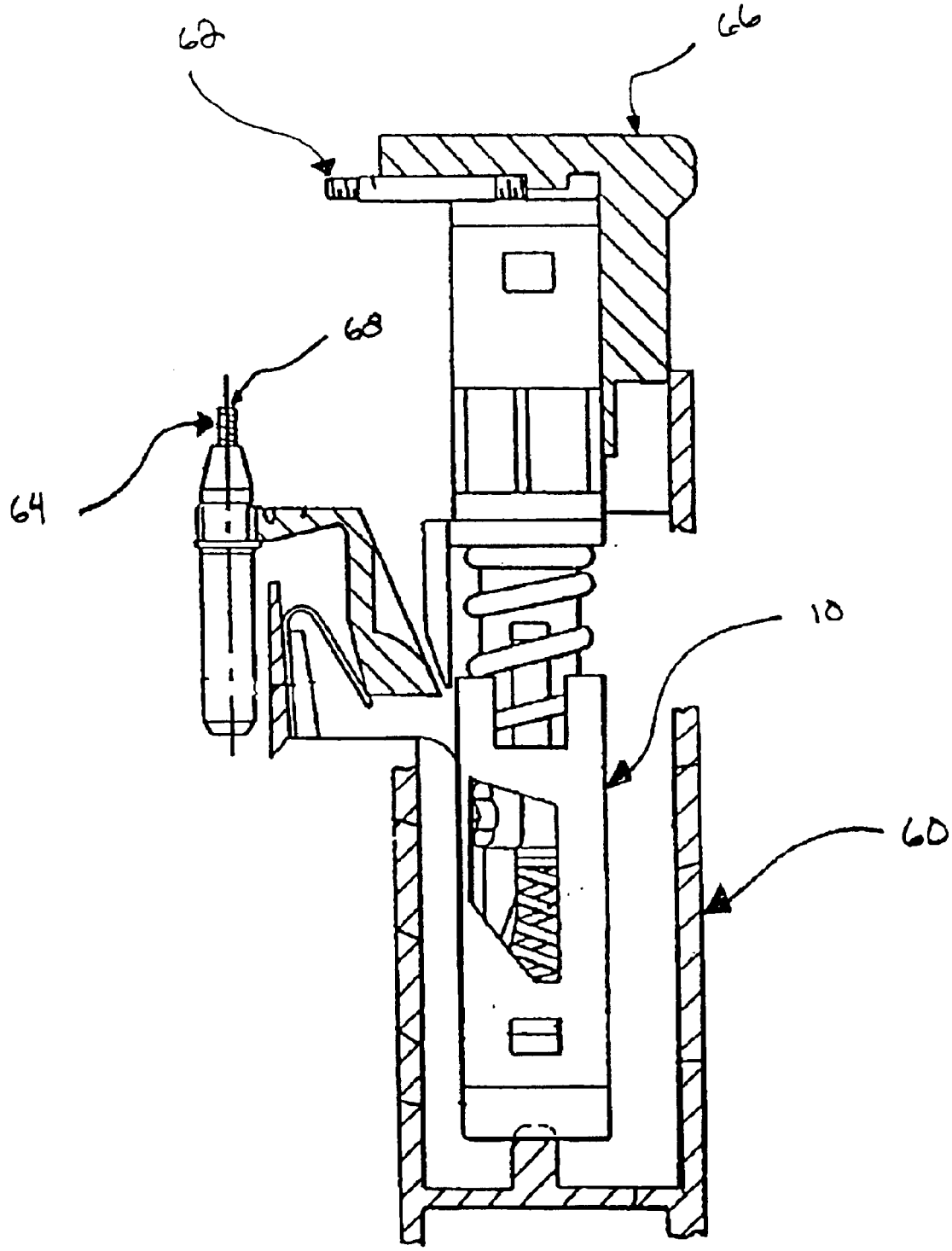
FIG. 13 is a front, partial cross-sectional view of the piezoelectric ignition mechanism of FIG. 1 incorporated into a lighter assembly, shown with the ignition mechanism in the first position.

Ignition mechanism 10 may be used to create a spark in a lighter. For example, ignition mechanism 10 may be included in an electrical circuit of a pocket lighter, such as the pocket lighter disclosed in U.S. Pat. No. 5,854,530, the content of which is expressly incorporated herein by reference thereto. As shown in FIG. 13, ignition mechanism 10 may be disposed within a lighter body 60, and connected in an electrical circuit that includes first and second electrodes 62, 64. Actuation of ignition mechanism 10 thus creates an electrical potential that is conducted through this circuit, and creates a potential difference between first and second electrodes 62, 64 that is sufficient to discharge a spark between the two electrodes. Ignition mechanism 10 may also be associated with a button 66 that operates a valve to release fuel from a nozzle 68. Thus, pressing button 66 simultaneously operates ignition mechanism 10 to create a spark and releases fuel from the nozzle, and ultimately creates a flame.

Ignition mechanism 10 may alternatively be included in an electrical circuit of an extended-wand type utility lighter, such as the utility lighter disclosed in U.S. Pat. No. 6,086,360, the content of which is also expressly incorporated herein by reference thereto. One of ordinary skill in the art will know and appreciate that ignition mechanism 10 may be used to create a spark in any type of lighter or other device, e.g., a stove or an outdoor grill.

Figure 14:
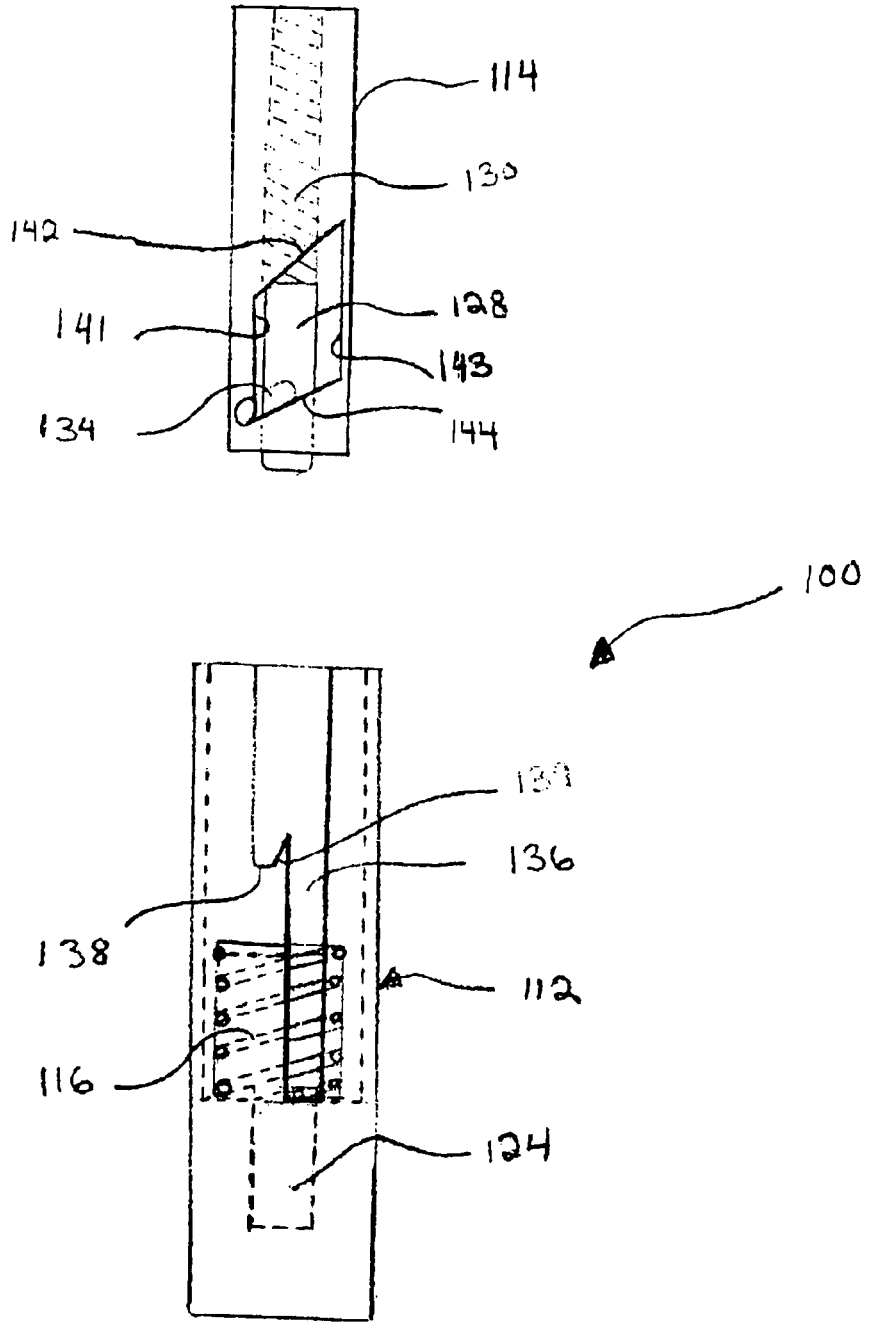
FIG. 14 is a is a front, partially-exploded view of a second embodiment of the piezoelectric ignition mechanism.
Figure 14A:
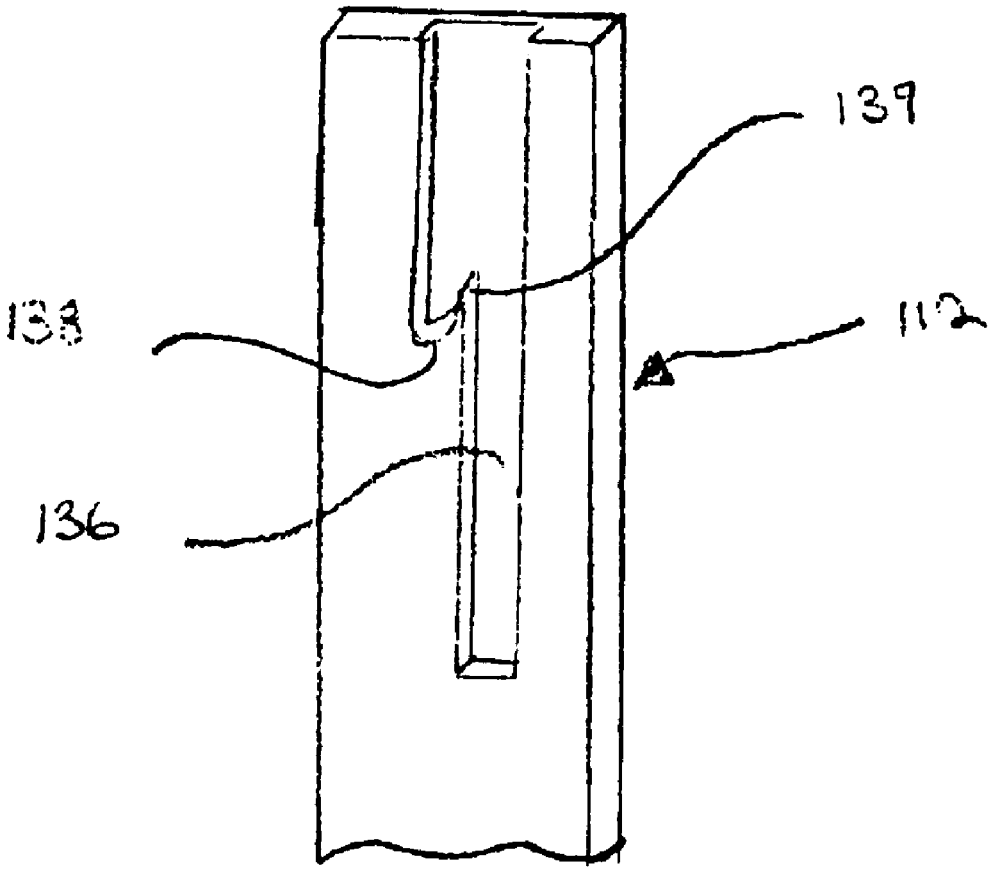
FIG. 14A is a side view of a wall portion of an alternative embodiment of a first body member of the ignition mechanism of FIG. 14.

FIG. 14 shows an alternative embodiment of a piezoelectric ignition mechanism, shown as 100. The structure and operation of ignition mechanism 100 is substantially similar to the embodiments described above, with only the differences described herein below. As shown, plexor member 128 and impact spring 130 are associated with second member 114, and piezoelectric element 124 is associated with first member 112. The upper and lower ramp surfaces 142, 144 and optional first and second side surfaces 141, 143 are defined on second member 114. Tracks 136, retaining surfaces 138 and optional engagement portions 139 are defined on the first member 112. As shown in FIG. 14, tracks 136 and retaining surfaces 138 may be defined by an aperture extending completely through the wall of first member 112. As shown in FIG. 14A, tracks 136 and/or retaining surfaces 138 may alternatively be defined by grooves or indentations formed in the wall of first member 112. One of ordinary skill in the art will know and appreciate, however, that any number of structures may be utilized to provide tracks 136 and retaining surfaces 138.

While preferred embodiments and features of the ignition mechanism and lighters using the ignition mechanism have been disclosed herein, it will be appreciated that numerous modifications and embodiments may be devised by those skilled in the art. It is intended that the claims not be limited to or by such preferred embodiments or features.

What is claimed:

1. A piezoelectric ignition mechanism comprising:

first and second body members moveable with respect to one another between a first position and a second position;

a piezoelectric element associated with one of the body members;

a plexor member associated with one of the body members; and an engagement portion associated with one of the body members;

wherein in the first position the plexor member is releasably retained at a distance from the piezoelectric element, and upon movement of the first and second body members toward the second position, the plexor member is released and driven to impact the piezoelectric element, and the engagement portion is configured end dimensioned to receive at least a portion of the plexor member and is configured and dimensioned to provide additional resistance against the release of the plexor member therefrom as the first and second body members move toward the second position.

2. The piezoelectric ignition mechanism of claim 1, wherein one of the body members defines a retaining surface for releasably retaining the plexor member at a distance from the piezoelectric element, and the engagement portion resists release of the plexor member from the retaining surface.

3. The piezoelectric ignition mechanism of claim 2, wherein the engagement portion is disposed on the retaining surface.

4. The piezoelectric ignition mechanism of claim 2, wherein:

the plexor member defines a lug portion;

the plexor member is rotatable with respect to the first and second body members;

rotation of the plexor member with respect to the first and second body members causes the lug portion to be released from the retaining surface; and the engagement portion is configured and dimensioned to resist release of the lug portion from the retaining surface.

5. The piezoelectric ignition mechanism of claim 4, wherein the engagement position includes a curved surface that at least partially surrounds the lug portion.

6. The piezoelectric ignition mechanism of claim 4, wherein the engagement portion includes a saw-tooth shaped portion.

7. The piezoelectric ignition mechanism of claim 4, wherein the engagement portion is resilient.

8. The piezoelectric ignition mechanism of claim 2, wherein:

the plexor member defines a lug portion;

one of the body members defines a ramp surface;

the ramp surface is configured and dimensioned to contact the lug portion and release the lug portion from the retaining surface upon movement of the first and second body members toward the second position; and the engagement portion is on the ramp surface.

9. The piezoelectric ignition mechanism of claim 8, wherein:

the plexor member is rotatable with respect to the first and second body members;

rotation of the plexor member with respect to the first and second body members causes the lug portion to be released from the retaining surface; and the engagement portion is configured and dimensioned to resist release of the lug portion from the retaining surface.

10. The piezoelectric ignition mechanism of claim 9, wherein the engagement portion includes a curved surface that at least partially surrounds the lug portion.

11. The piezoelectric ignition mechanism of claim 9, wherein the engagement portion includes a saw-tooth shaped portion.

12. The piezoelectric ignition mechanism of claim 9, wherein the engagement portion is resilient.

13. The piezoelectric ignition mechanism of claim 8, wherein one of the body members further defines a track substantially adjacent to the retaining surface, and upon release of the lug portion from the retaining surface, the lug slides in the track as the plexor member is driven toward the piezoelectric element.

14. The piezoelectric ignition mechanism of claim 1, further comprising a spring for biasing the plexor member toward the piezoelectric element.

15. The piezoelectric ignition mechanism of claim 1, used to create a spark in a lighter.

16. The piezoelectric ignition mechanism of claim 1, used to create a spark in a utility lighter having a gas outlet disposed at an end of an extended-wand.

17. A piezoelectric ignition mechanism comprising:

first end second body members moveable with respect to one another between a first position and a second position, one of the body members defining a track and a retaining surface substantially adjacent the track, the retaining surface having an engagement portion;

a piezoelectric element disposed on one of the body members; and a plexor member resiliently biasable toward the piezoelectric element, the plexor member having at least one lug portion;

wherein when the body members are in the first position, the lug portion is retained by the retaining surfaces and the plexor member is resiliently biasable toward the piezoelectric element, and when the first and second members are moved a predetermined distance toward the second position, the engagement portion is sized and configured to releasably engage the at least one lug portion to provide resistance against the lug portion releasing from the engagement portion.

18. The piezoelectric ignition mechanism of claim 17, wherein the lug portion cooperates with the engagement portion to resist movement of the body members toward the second position.

19. The piezoelectric ignition mechanism of claim 17, wherein the engagement portion includes a curved surface that at least partially surrounds the lug portion.

20. The piezoelectric ignition mechanism of claim 17, wherein the engagement portion includes a saw-tooth shaped portion.

21. The piezoelectric ignition mechanism of claim 17, wherein the engagement portion is resilient.

22. The piezoelectric ignition mechanism of claim 17, further comprising a spring for biasing the plexor member toward the piezoelectric element.

23. The piezoelectric ignition mechanism of claim 17, used to create a spark in a lighter.

24. The piezoelectric ignition mechanism of claim 17, used to create a spark in a utility lighter having a gas outlet disposed at an end of an extended-wand.

25. A piezoelectric ignition mechanism comprising:

first and second body members movable with respect to one another between a first position and a second position, one of the body members defining a track and a retaining surface substantially adjacent the track, and the other one of the body members defining an engagement portion;

a piezoelectric element disposed on one of the body members; and a plexor member resiliently biasable toward the piezoelectric element, the plexor member having at least one lug portion;

wherein when the body members are in the first position, the lug portion is retained by the retaining surface and the plexor member is resiliently biasable toward the piezoelectric element, and when the first and second members are moved a predetermined distance toward the second position, the engagement portion is sized and configured to releasably engage the at least one lug portion to provide resistance against the lug portion releasing from the engagement portion.

26. The piezoelectric ignition mechanism of claim 25, wherein the lug portion cooperates with the engagement portion to resist movement of the body members toward the second position.

27. The piezoelectric ignition mechanism of claim 25, wherein the other one of the body members defines a ramp surface for releasing the lug portion from the retaining surface, and the engagement portion is disposed on the ramp surface.

28. The piezoelectric ignition mechanism of claim 25, wherein the engagement portion includes a curved surface that at least partially surrounds the lug portion.

29. The piezoelectric ignition mechanism of claim 25, wherein the engagement portion includes a saw-tooth shaped portion.

30. The piezoelectric ignition mechanism of claim 25, wherein the engagement portion is resilient.

31. The piezoelectric ignition mechanism of claim 25, further comprising a spring for biasing the plexor member toward the piezoelectric element.

32. The piezoelectric ignition mechanism of claim 25, used to create a spark in a lighter.

33. The piezoelectric ignition mechanism of claim 25, used to create a spark in a utility lighter having a gas outlet disposed at an end of an extended-wand.

* * * * *